US011912474B2

(12) United States Patent
Dowden

(10) Patent No.: US 11,912,474 B2
(45) Date of Patent: Feb. 27, 2024

(54) BOX INSERT AND CORRESPONDING BOX ASSEMBLY

(71) Applicant: Philip Dowden, Macy, IN (US)

(72) Inventor: Philip Dowden, Macy, IN (US)

( * ) Notice: Subject to any disclaimer, the term of this patent is extended or adjusted under 35 U.S.C. 154(b) by 27 days.

(21) Appl. No.: 17/892,088

(22) Filed: Aug. 21, 2022

(65) Prior Publication Data

US 2023/0202707 A1 Jun. 29, 2023

Related U.S. Application Data

(60) Provisional application No. 63/294,331, filed on Dec. 28, 2021.

(51) Int. Cl.

| | |
|---|---|
| ***B65D 5/49*** | (2006.01) |
| ***B65D 5/355*** | (2006.01) |
| ***B65D 77/04*** | (2006.01) |
| ***B65D 5/72*** | (2006.01) |

(52) U.S. Cl.

CPC ..... *B65D 5/48026* (2013.01); *B65D 5/0005* (2013.01); *B65D 5/724* (2013.01); *B65D 77/046* (2013.01); *B65D 77/0466* (2013.01)

(58) Field of Classification Search

CPC ..... B65D 5/0005; B65D 5/48026; B65D 5/5035; B65D 5/68; B65D 5/724; B65D 77/046; B65D 77/0466; B65D 25/22; B65D 73/0064; B65D 33/14; B65D 81/07

USPC ..... 229/101, 101.1, 101.2; 206/804, 583, 206/585, 587, 521, 806; 220/254, 1

See application file for complete search history.

(56) References Cited

U.S. PATENT DOCUMENTS

| | | | | | |
|---|---|---|---|---|---|
| 795,110 | A | * | 7/1905 | Fonts | B65D 85/34 217/3 BC |
| 866,243 | A | * | 9/1907 | Waechter | B65D 85/804 33/525 |
| 1,146,515 | A | | 7/1915 | Potter | |
| 1,608,422 | A | | 11/1926 | Plass | |
| 1,935,923 | A | | 11/1933 | Thoke | |
| 2,153,333 | A | * | 4/1939 | Lowey | B65D 5/4204 229/162.1 |
| 2,531,090 | A | | 11/1950 | Turner | |
| 2,547,005 | A | * | 4/1951 | Herrick | B65D 5/566 206/521 |
| 2,950,039 | A | | 8/1960 | Wilson | |
| 3,005,717 | A | | 10/1961 | Pilibos | |
| 3,012,660 | A | | 12/1961 | Sheldon, Jr. | |
| 3,108,731 | A | | 10/1963 | Royce | |
| 3,521,810 | A | * | 7/1970 | Boyer | B65D 5/38 229/148 |

(Continued)

*Primary Examiner* — Steven A. Reynolds
*Assistant Examiner* — Prince Pal

(57) ABSTRACT

The present invention relates to a box insert and a box system that uses said box insert. The box insert may have an insert bottom and four insert side walls extending from the insert bottom. A flap may extend from each insert side wall. Each flap may have a first panel connected to its respective insert side wall by a first score line, a second panel connected to the first panel by a second score line, and a third panel connected to the second panel by a second score line. The box insert may be configured inside of a box whereby one of the score lines of each flap is folded over a box edge to suspend the box insert inside of the box. A box lid may be configured over the box insert to help secure the box insert to the box.

14 Claims, 4 Drawing Sheets

(56) References Cited

U.S. PATENT DOCUMENTS 4,191,288 A * 3/1980 Hostad ..... B65D 5/5246 229/164
4,264,006 A 4/1981 Swanberg
4,957,237 A 9/1990 Madonna
5,525,030 A 6/1996 Buchman
6,745,918 B2 * 6/2004 Greene ..... B65D 83/0005 426/115
7,407,086 B2 * 8/2008 Borio ..... B65D 19/20 229/101
8,602,212 B2 * 12/2013 Scanzillo ..... B65D 5/002 206/427
9,150,343 B2 * 10/2015 Roberts ..... B65D 81/075
9,718,596 B1 8/2017 Russell et al.
9,738,429 B2 * 8/2017 Buelna ..... B65D 81/07
11,091,307 B2 8/2021 Melby et al.
11,161,646 B1 * 11/2021 Parrish ..... B65D 5/541
11,338,974 B2 5/2022 Dhodapkar et al.
2006/0138018 A1 * 6/2006 McDonald ..... B65D 5/5021 206/583
2006/0151356 A1 * 7/2006 Beaty ..... B65D 5/526 206/774
2007/0056968 A1 * 3/2007 Giwargis ..... B65D 83/005 220/8
2013/0048533 A1 * 2/2013 McDonald ..... B65D 5/5021 206/591
2013/0270307 A1 * 10/2013 Crosby ..... B65D 51/20 222/530
2014/0048435 A1 * 2/2014 Ullrich ..... B65D 5/5213 53/473
2016/0137384 A1 * 5/2016 Buelna ..... B65D 81/07 206/583
2019/0061989 A1 * 2/2019 Sager ..... B32B 29/005
2019/0061997 A1 * 2/2019 Behrens ..... B65D 77/061
2021/0269191 A1 * 9/2021 Peterson ..... B65D 5/0209
2023/0150718 A1 * 5/2023 Mack ..... B65D 81/07 229/164.2

* cited by examiner

BOX INSERT AND CORRESPONDING BOX ASSEMBLY

This application claims priority to application No. 63/294,331 filed on Dec. 28, 2021, which is hereby incorporated by reference.

BACKGROUND OF THE INVENTION

The present invention relates to the fields of packaging and shipping containers. A common packaging and shipping container that exists in the art is the Gaylord box, which is generally designed to fit on top of a pallet. The family of packaging and shipping containers known in the art as Gaylord boxes comprises boxes of a variety of shapes and sizes. One of said shapes and sizes is the 4-walled, 48"×40"×36" Gaylord box, referred to herein as the "standard Gaylord box". This size of Gaylord box is designed to fit on top of a pallet and to contain a variety of cargo.

Gaylord boxes comprise one storage space that is relatively large compared to other packaging and shipping containers in the art. This presents an advantage in that multiple large items can be stored in one Gaylord box. However, the single large storage space also presents a disadvantage since it can be impractical to store different types of cargo in one box. For example, one would not want to store empty glass bottles in the same box as large wooden barrels, since the large wooden barrels would break the glass bottles during transit. This disadvantage can be overcome by adding additional packaging materials such as foam, bubble wrap, or other cushioning materials to the Gaylord box. However, additional packaging materials cost extra money, take up extra space in the shipping/packaging container, and require extra time to implement into a shipping/packaging container.

Another disadvantage of Gaylord boxes is their overall structure. Gaylord boxes are essentially large prisms made of cardboard. While cardboard maintains its structural integrity when used to construct smaller prisms such as shoeboxes or the like, it does not maintain its structural integrity well when used to construct larger prisms such as Gaylord boxes. One manner overcoming this disadvantage is to use thicker cardboard or multiple layers of cardboard to construct Gaylord boxes. However, these methods can be relatively costly. A less costly method of maintaining the structural integrity of a Gaylord box is to use a box insert that fits inside of the Gaylord box and aids in holding the original shape of the Gaylord box when the Gaylord box is subjected to forces such as the normal force of cargo pressing up against the walls of the Gaylord box.

SUMMARY OF THE INVENTION

The present invention relates to a box insert and a box system that uses the box insert. The box inset may have an insert bottom, an insert opening opposite the insert bottom, and an insert depth extending from the insert opening to the insert bottom. The box insert may have four side walls, each extending from the insert bottom to the insert opening. A flap may extend from each of the four insert side walls. Each flap may have a first panel, a second panel, and a third panel. A first score line may separate the first panel from its corresponding insert side wall. A second score line may separate the second panel from the first panel. A third score line may separate the third panel from the second panel.

The box insert may be made of cardboard. The box insert may further be made of corrugated cardboard. The first, second, and third score lines may exist as cuts on one surface of each flap so that the panels of each flap may be folded along the cuts. The first, second, and third score lines may alternatively exist as indented material on one surface of each flap resulting in protruding material on the opposite surface of each flap so that the panels of each flap may be folded along the protruding material.

The box insert with its flaps may be shaped as an inverted box lid so that the box insert may be implemented via an opening of a box to create a platform within the box, without adding any height to the box except for any height added by folding the flaps over the edge of the box.

The box system may also have a box. The box may have a box bottom and a box opening opposite the box bottom. A box depth may extend from the box opening to the box bottom. A box edge may be configured at the box opening. Box side walls may extend from the box bottom to the box opening. The box side walls may form the box edge at the box opening. The box may be a Gaylord box. A Gaylord box is a large cardboard box designed to fit on a pallet. The box may have a rectangular cross-section cut between the box bottom and the box opening. This rectangular cross-section may be about 30" or more by about 30" or more, about 40" or more by about 40" or more, about 48" or more by about 48" or more, and any range between and including the values provided. The box may be a standard Gaylord box as defined herein. The box may alternatively have a hexagonal cross-section cut between the box bottom and the box opening. This hexagonal cross-section may be about 30" or more by about 30" or more by about 30" or more, about 40" or more by about 40" or more by about 40" or more, about 48" or more by about 48" or more by about 48" or more, and any range between and including the values provided. The box may be made of single-walled cardboard, double-walled cardboard, triple-walled cardboard, four-walled cardboard, five-walled cardboard, or six-walled cardboard. Each wall of the single-walled cardboard, double-walled cardboard, triple-walled cardboard, four-walled cardboard, five-walled cardboard, or six-walled cardboard may be a wall of corrugated cardboard.

The box insert may be configured inside of the box via the box opening whereby the insert bottom is configured parallel to the box bottom. The first score line of each flap of the box insert may be used to fold each flap over the box edge, thereby suspending the box insert inside of the box whereby the insert bottom is suspended above the box bottom. In this configuration, the insert depth may extend downward into the box from the first score line to the insert bottom. Alternatively, the second score line of each flap of the box insert may be used to fold each flap over the box edge, thereby lowering the box insert into the box and increasing the insert depth. Alternatively, the third score line of each flap of the box insert may be used to fold each flap over the box edge, thereby lowering the box insert further into the box and increasing the insert depth. The insert depth may be about 50% the box depth or less, about 30% the box depth or less, about 20% the box depth or less, and any range between and including the values provided.

When the flap of each box insert is folded over the box edge along its respective first score line, each flap may extend a flap angle from the box. When the flap of each box insert is folded over the box edge along its respective second score line, each flap may extend a flap angle from the box, which may be greater than the flap angle when each flap is folded along its first score line. When the flap of each box insert is folded over the box edge along its respective third score line, each flap may extend a flap angle from the box, which may be greater than the flap angle when each flap is folded along its second score line.

The box system may have a box lid. The box lid may have an inside. The box lid may be configured over the box and the box insert wherein the inside of the box lid contacts the box insert. The inside of the box lid may press against the flaps of the box insert thereby reducing the flap angle of each flap. The configuration of the box lid over the box insert and the box may secure the box insert in place when the box insert is configured inside of the box.

Items may be placed into the box and/or box insert. When items are placed into the box insert, the items may be placed on the insert bottom whereby the items are suspended above the box bottom. The folding of the flaps over the box edge and the configuration of the box lid over the box insert may serve to hold the box insert in place within the box, thereby keeping the items suspended above the box bottom. Furthermore, the flaps of the box insert may be adhered to the box side walls by a connecting means. The connecting means may be but is not limited to an adhesive, staples, screws, nails, zip-ties, or the like. Adhering the flaps of the box insert to the box side walls may further serve to hold the box insert in place within the box, thereby keeping items suspended above the box bottom when items are placed into the box insert. When the flaps of the box insert are adhered to the box side walls, the flap angle of each flap may be no more than 5 degrees, no more than 2 degrees, no more than 1 degree, and any range between and including the values provided.

The configuration of the box insert inside of the box may cause the insert side walls of the box insert to press against the corresponding box side walls. In this configuration, the box insert may serve to provide structural support for the box and to retain the shape of the box when the box is subjected to forces that would otherwise bend or collapse the box side walls.

DETAILED DESCRIPTION

The description provided herein describes example embodiments of the present invention and is not intended to limit the invention to any particular embodiment, features, components, shape, size, design, material, or any other property. Furthermore, the drawings provided herein show example embodiments of the present invention and are not intended to limit the invention to any particular embodiment, features, components, shape, size, design, material, or any other property.

Figure 1:
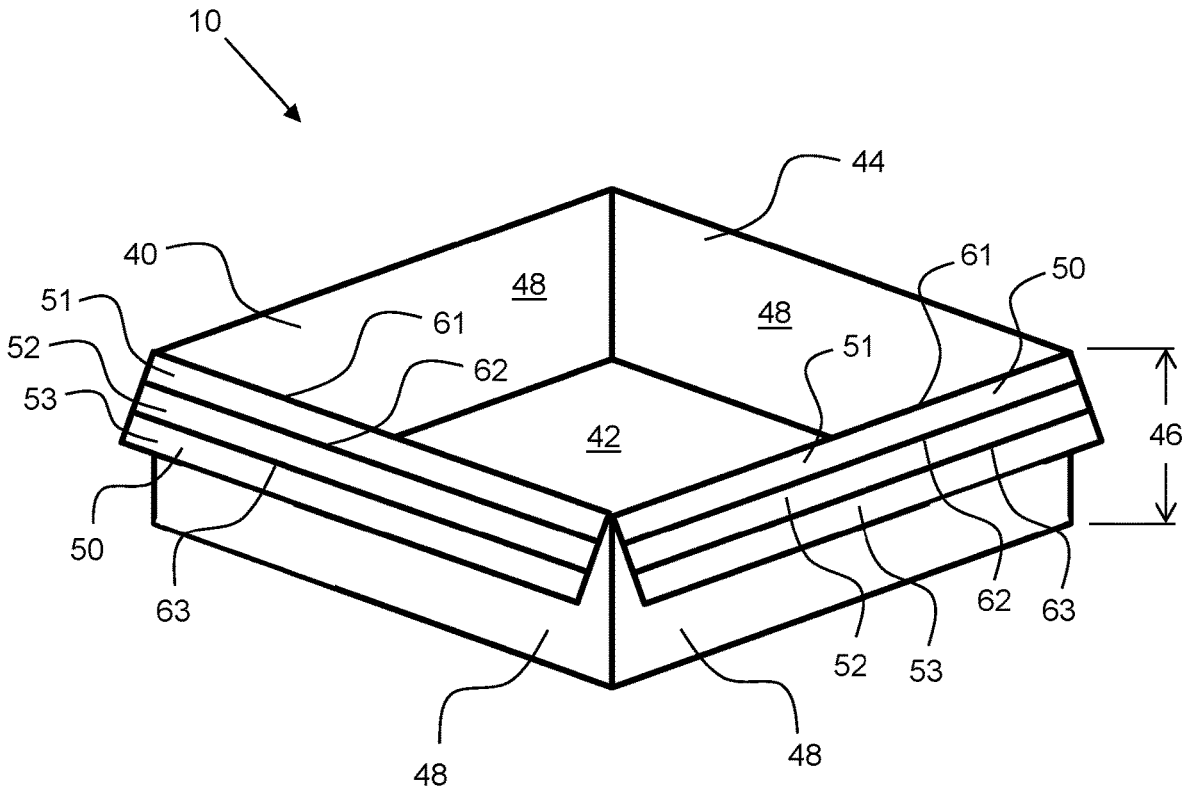
FIG. 1 shows a top front perspective view of a box insert of a box system.

As shown in FIG. 1, a box insert 40 of a box system 10 has an insert bottom 42 and an insert opening 44 opposite the insert bottom 42. Four insert side walls 48 extend an insert depth 46 from the insert bottom 42 to the insert opening 44. Four flaps 50 extend from the four insert side walls 48 whereby one flap 50 extends from each insert side wall 48. Due to the view of FIG. 1, only two flaps 50 are shown. Each flap 50 has a first panel 51, a second panel 52, and a third panel 53. The first panel 51 of each flap 50 is separated from its respective insert side wall 48 by a first score line 61. The second panel 52 of each flap 50 is separated from the first panel 51 by a second score line 62. The third panel 53 of each flap 50 is separated from the second panel 52 by a third score line 63. As shown in FIG. 1, each panel 50 is folded along its first score line 61 whereby the first score line 61 of each panel is adjacent to the insert opening 44.

Figure 2:
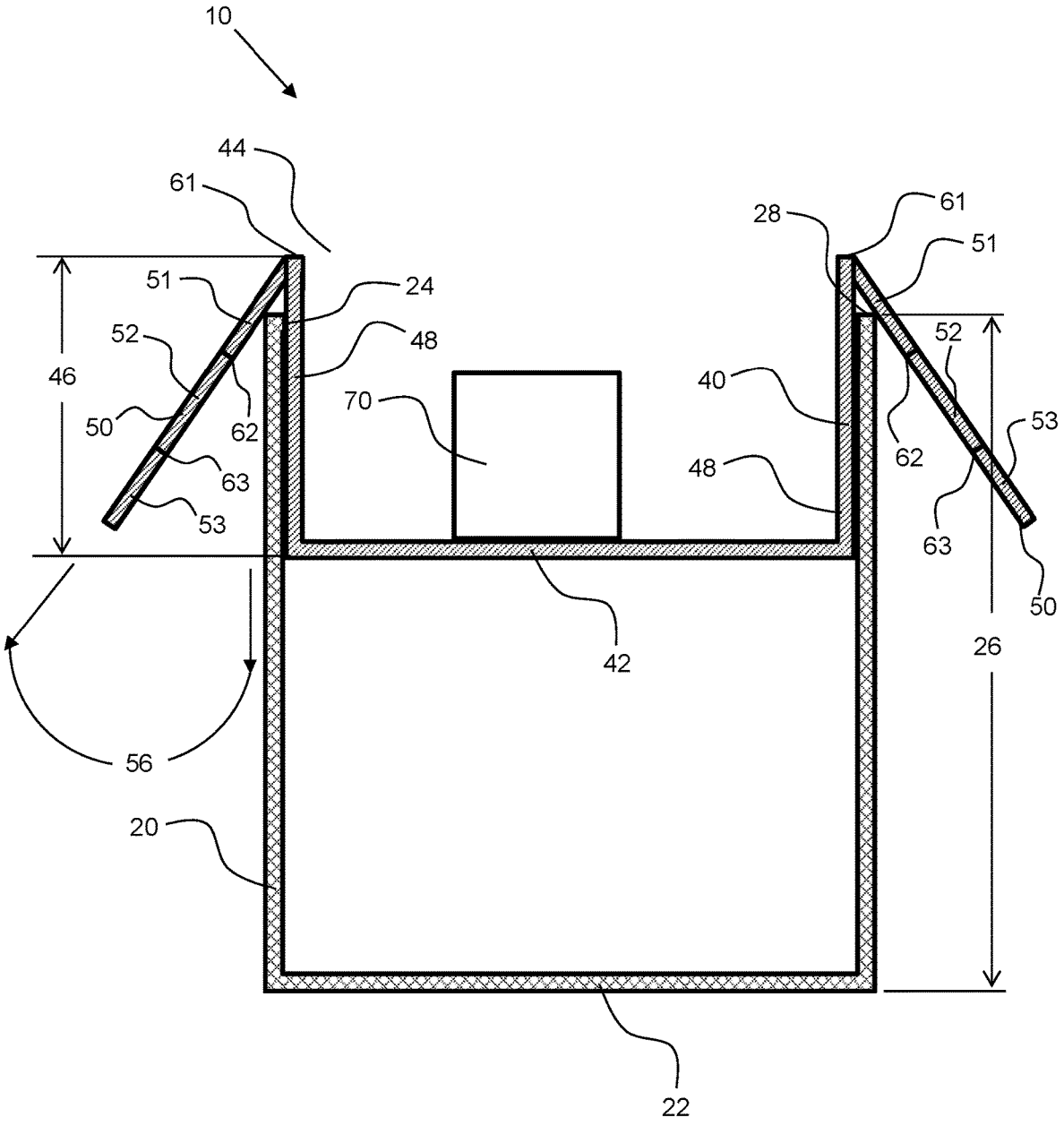
FIG. 2 shows a front cross-section view of a box system with a box insert folded along a first score line.

As shown in FIG. 2, a box system 10 has a box 20 with a box bottom 22 and a box opening 24 opposite the box bottom 22. A box edge 28 is adjacent to the box opening 24. A box depth 26 extends from the box bottom 22 to the box opening 24, which means that the box depth 26 also extends from the box bottom 22 to the box edge 28. A box insert 40 is configured within the box 20 whereby the first score line 61 of each flap 50 of the box insert 40 is folded along the box edge 28. Each flap 50 extends from the box 20 at a flap angle 56. Since each flap 50 is folded along its first score line 61; the first panel 51, second panel 52, and third panel 53 of each flap 50 extend from the box 20 at the flap angle 56. The insert depth 46 extends from the first score line 61 of each flap 50 down into the box 20 to the insert bottom 42. In this configuration, an item 70 may be configured on the insert bottom 42 whereby the item 70 is suspended above the box bottom 22.

Figure 3:
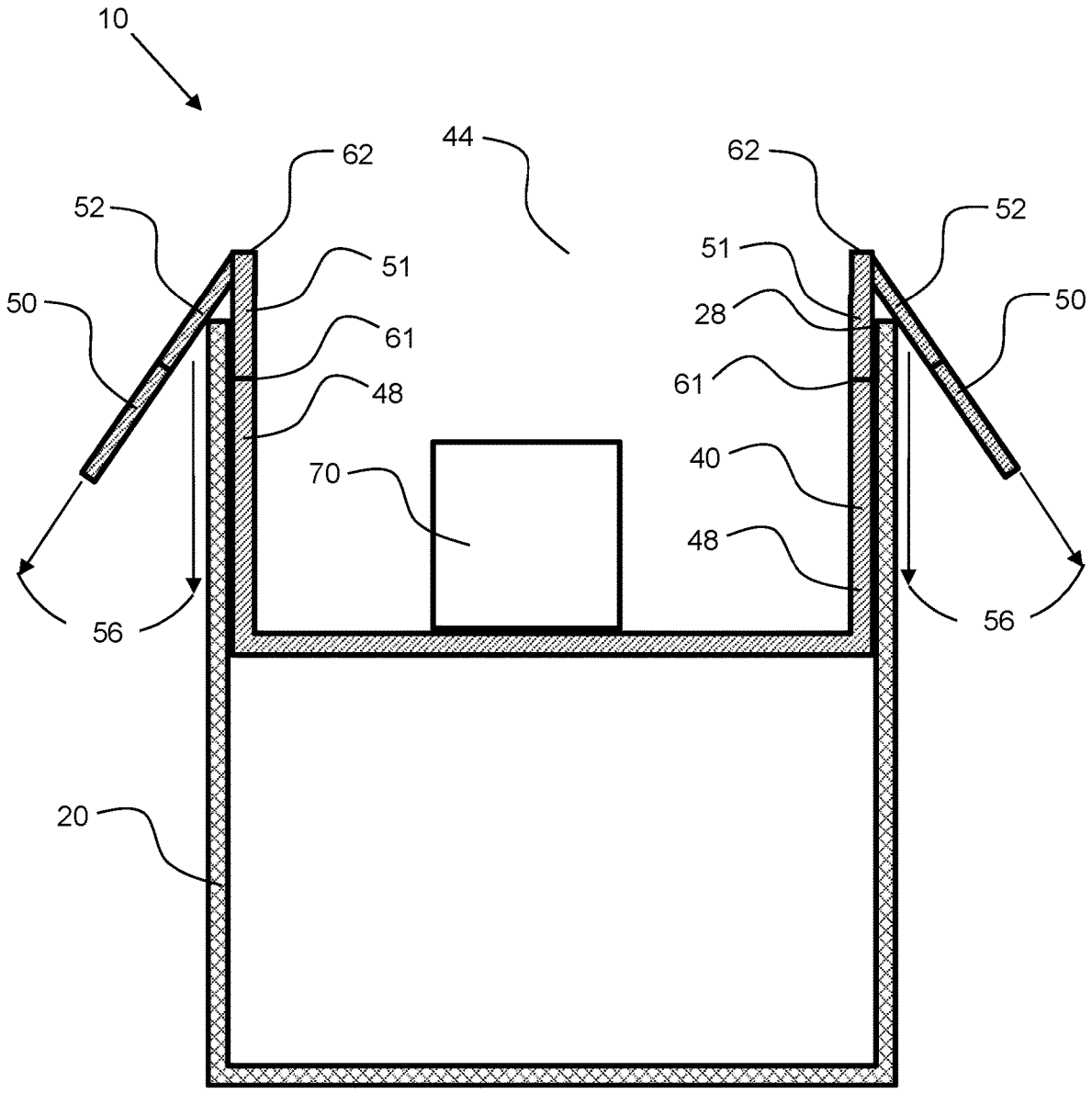
FIG. 3 shows a front cross-section view of a box system with a box insert folded along a second score line.

As shown in FIG. 3, each flap 50 of the box insert 40 is folded along its second score line 62 whereby the first panel 51 of each flap 50 is configured to be part of its respective insert side wall 48. In this configuration, the second score line 62 of each flap 50 is folded along the box edge 28 and is configured adjacent to the insert opening 44. This causes the insert 40 to sit lower inside of the box 20, thereby increasing the insert depth. This causes the item 70 to be suspended closer to the box bottom 22. The second panel 52 and third panel 53 of each flap 50 extend from the box 20 at a flap angle 56. The flap angle shown in FIG. 2 is larger than the flap angle shown in FIG. 1 due to the fact that the flaps in FIG. 1 are longer than the flaps in FIG. 2. This is because the flaps shown in FIG. 1 are each made of three panels rather than two. Therefore, the flaps shown in FIG. 1 weigh more than the flaps shown in FIG. 2, and therefore have a greater force pulling them downwards, thereby decreasing the flap angle between the flaps and the box.

Figure 4:
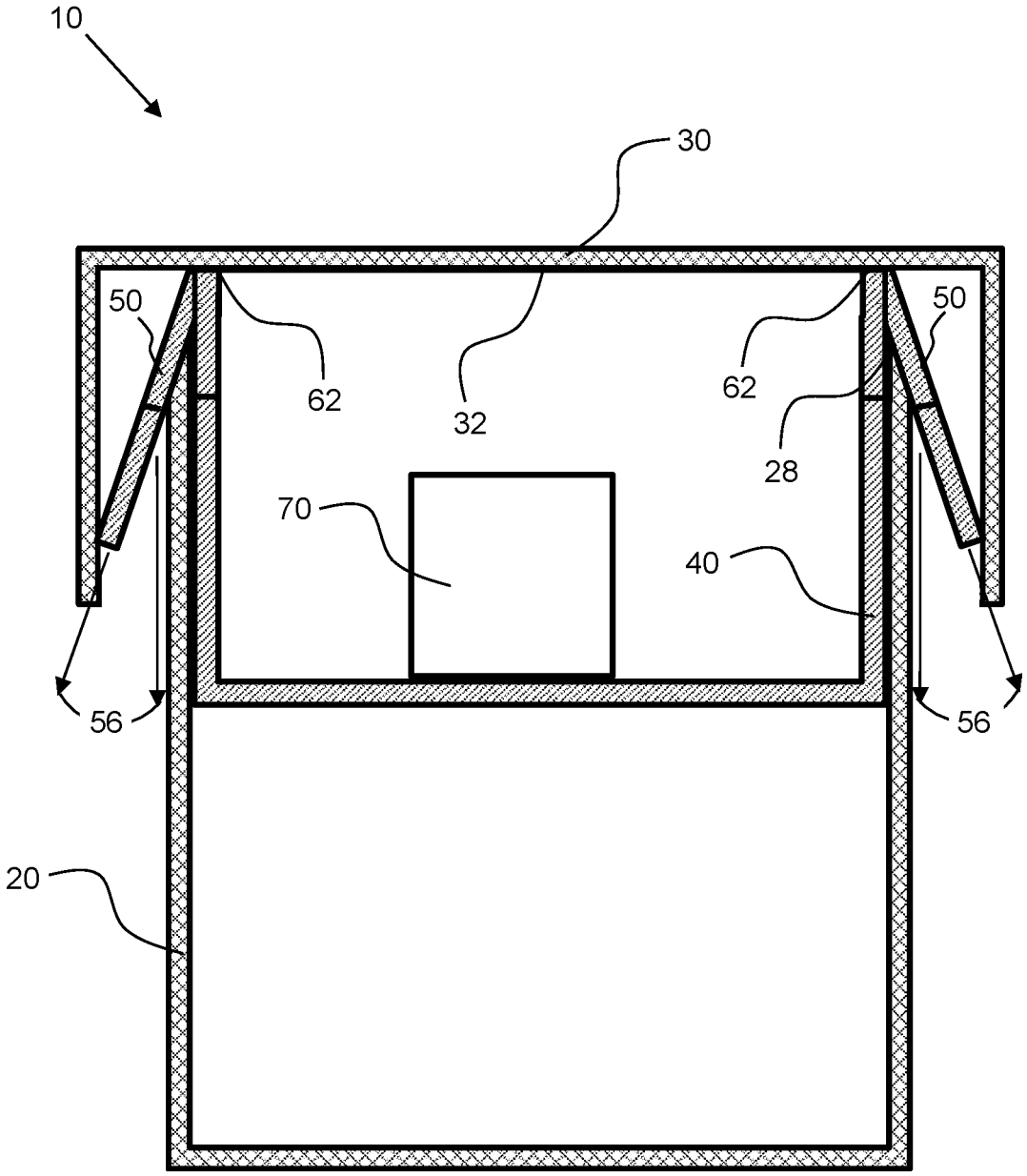
FIG. 4 shows a front cross-section view of a box system with a lid placed over a box and box insert.

As shown in FIG. 4, a box lid 30 is configured over the box 20 and box insert 40 whereby an inside 32 of the box lid 30 contacts the box insert 40. Similar to the configuration shown in FIG. 3, each flap 50 shown in FIG. 4 is folded along its second score line 62 whereby the second score line 62 of each flap 50 is folded along the box edge 28. Each flap 50 extends from the box 20 at a flap angle 56. The flap angle shown in FIG. 4 is less than the flap angle shown in FIG. 3 since the box lid 30 of FIG. 4 pushes the flaps 50 towards the box 20. The box lid 30 may push the flaps towards the box 20 so that the flaps 50 contact the box 20.

What is claimed is:

1. A box insert comprising:

an insert bottom;

an insert opening opposite the insert bottom;

an insert depth extending from the insert opening to the insert bottom;

four insert side walls;

four insert flaps, each flap extending from one of the four insert side walls, each flap comprising:

a first panel;

a second panel;

a third panel;

a first score line separating the first panel from its corresponding insert side wall;

a second score line separating the second panel from the first panel; and a third score line separating the third panel from the second panel, wherein the box insert is placed into a box whereby the insert bottom is parallel to a bottom of said box, wherein the first score line of each flap is used to fold each flap over an edge of said box whereby the box insert is suspended inside of the box, wherein each flap extends outward from the box at a flap angle, and wherein a box lid is placed over the box and the box insert thereby reducing the flap angle and causing each flap to press against an inside of the box lid.

2. The box insert of claim 1, wherein the insert depth is increased by using the second score line of each flap to fold each flap over the edge of the box.

3. The box insert of claim 1, wherein the insert depth is increased by using the third score line of each flap to fold each flap over the edge of the box.

4. The box insert of claim 3, wherein the box comprises:

a. a box opening opposite the bottom of the box; and b. a box depth extending from the box opening to the bottom of the box, wherein the insert depth is not more than 50% the box depth.

5. The box insert of claim 4, wherein the insert depth is not more than 30% the box depth.

6. The box insert of claim 5, wherein the insert depth is not more than 20% the box depth.

7. The box insert of claim 1, wherein the box insert is made of corrugated cardboard.

8. A box system comprising:

a. a box comprising:

i. a box bottom;

ii. a box opening opposite the box bottom;

iii. a box depth extending from the box opening to the box bottom;

iv. a box edge configured at the box opening;

b. a box lid;

c. a box insert comprising;

i. an insert bottom;

ii. an insert opening opposite the insert bottom;

iii. an insert depth extending from the insert opening to the insert bottom;

iv. four insert side walls;

v. four insert flaps, each flap extending from one of the four insert side walls, each flap comprising:

1. A first panel;

2. A second panel;

3. A third panel;

4. A first score line separating the first panel from its corresponding insert side wall;

5. A second score line separating the second panel from the first panel; and 6. a third score line separating the third panel from the second panel, wherein the box insert is placed into the box via the box opening whereby the insert bottom is parallel to the box bottom, wherein the first score line of each flap is used to fold each flap over the box edge whereby the box insert is suspended inside of the box, wherein each flap extends outward from the box at a flap angle, and wherein the box lid is placed over the box and the box insert thereby reducing the flap angle and causing each flap to press against an inside of the box lid.

9. The box system of claim 8, wherein the insert depth is increased by using the second score line of each flap to fold each flap over the edge of the box.

10. The box insert of claim 8, wherein the insert depth is increased by using the third score line of each flap to fold each flap over the edge of the box.

11. The box insert of claim 10, wherein the insert depth is not more than 50% the box depth.

12. The box insert of claim 11, wherein the insert depth is not more than 30% the box depth.

13. The box insert of claim 12, wherein the insert depth is not more than 20% the box depth.

14. The box insert of claim 8 wherein the box, box lid, and box insert are made of corrugated cardboard.

* * * * *